United States Patent [19]

Vroomen

[11] Patent Number: 4,656,701

[45] **Date of Patent: * Apr. 14, 1987**

[54] CORDUROY CUTTING MACHINE AND METHOD OF OPERATION THEREOF

[75] Inventor: Albert Vroomen, Moenchengladbach, Fed. Rep. of Germany

[73] Assignee: Franz Müller GmbH & Co., Moenchengladbach, Fed. Rep. of Germany

[ * ] Notice: The portion of the term of this patent subsequent to Jan. 7, 2003 has been disclaimed.

[21] Appl. No.: 748,020

[22] Filed: Jun. 24, 1985

Related U.S. Application Data

[63] Continuation-in-part of Ser. No. 451,874, Dec. 21, 1982, abandoned.

[30] Foreign Application Priority Data

Dec. 22, 1981 [DE] Fed. Rep. of Germany ..... 3150735

[51] Int. Cl.[4] ..... D06C 13/08

[52] U.S. Cl. ..... 26/10 C

[58] Field of Search ..... 26/10 R, 10 C

[56] References Cited

U.S. PATENT DOCUMENTS

| | | | |
|---|---|---|---|
| 2,895,209 | 7/1959 | Sanders | 26/10 C |
| 2,897,574 | 8/1959 | Sanders | 26/10 R |
| 3,044,141 | 7/1962 | Gaskins | 26/10 C |
| 4,532,683 | 8/1985 | Vroomen | 26/10 C |
| 4,563,798 | 1/1986 | Vroomen | 26/10 C |

*Primary Examiner*—Robert R. Mackey

*Attorney, Agent, or Firm*—Herbert L. Lerner; Laurence A. Greenberg

[57] ABSTRACT

Corduroy cutting machine, including a shaft, a plurality of circular knives disposed adjacent each other on the shaft for cutting open floating wefts of a fabric web being movable along a given travel direction, a plurality of needles having points and having longitudinal slots formed therein for receiving portions of the knives defining a cutting edge opposite the knives, a device for inserting the needles into the floating wefts to be cut open in the direction opposite the given travel direction, a contact table disposed below the needle points, a device for stopping the cutting machine upon contact between the contact table and one of the needles, the needles and the contact table defining a working plane for a cutting operation into which the fabric web is guidable from below over the contact table to the cutting edge, a rear table disposed at a distance from the contact table upstream of the needle points in the given travel direction, a device for holding the rear table in the working plane during the cutting operation, a device for lowering the rear table, and the contact table from the working plane, a needle supporting table, and a device for moving the needle supporting table into a region directly below any of the needle points still disposed in the working plane when the rear table is lowered.

10 Claims, 4 Drawing Figures

CORDUROY CUTTING MACHINE AND METHOD OF OPERATION THEREOF

This is a continuation-in-part application of Ser. No. 451,874, filed Dec. 21, 1982, and now abandoned.

BACKGROUND OF THE INVENTION

1. Field of the Invention

The invention relates to a corduroy cutting machine having a shaft on which a plurality of circular knives are mounted adjacent one another, the knives being insertable into longitudinal slots formed in needles which are respectively pushed into floating wefts to be cut open in the direction opposite the travel of the fabric web, a contact table disposed below the needle points for activating a switch for stopping the machine when touched by a needle, and a rear table disposed before the needle points in the fabric web travel direction, at a distance from the contact table, the rear table being held during the cutting operation in a working plane extending through the needles and the contact table, the fabric web being drawn from below into the working plane and over the contact table to a cutting edge which is opposite the circular knives, and the rear table and the contact table being lowered at random from the working plane.

2. Description of the Prior Art

Corduroy machines are known, for example, from German Patent DE-PS 27 40 402. These machines serve for producing filling or weft pile fabric, particularly ribbed velvet. In the case of filling pile fabric, the pile is obtained by means of a special weft, the right-side floats of which are cut open in a corduroy cutting machine. The cutting occurs during an operation wherein the fabric, subjected to tension in the warp direction, is drawn over a cutting edge, which acts together with a knife shaft. In this way, the floating wefts form tubes, and each tube runs onto one of the needles. Each needle has a longitudinal slot, into which one of the circular knives mounted on the knife shaft is partially inserted. Through adjustment of the knife shaft, swiveling vertically to the longitudinal axis thereof, the gap between the periphery of the circular knives and the cutting edge of the machine can be adjusted so that the floating wefts of the web travelling through are cut, but the ground web or backing is undamaged.

For normal operation of the machine, it is preferable for the needles to be intermittently pushed for guidance, so that the needle points exit neither outward through the ground web or backing nor upward from the tube. In the case of such a needle withdrawal, special contact rails are disposed above and below the needles so that one needle withdrawal results in a respective signal for an immediate stop of the machine. During the operation of a corduroy cutting machine, in many cases sewn-together pieces having a length of 100 to 120 meters are cut in turn. By using fabric speeds of only 10 meters per minute, the net cutting time per piece is also approximately 10 to 12 minutes. Following a transferring of needles, for example, five needles per centimeter fabric width are required from the finished cut piece to the next piece to pass over the seam in question. This needle transfer lasts through the time for withdrawing the needles from the finished piece and the insertion of the needles into the next piece.

The time for withdrawal, which in previous machines was approximately one-third of the total transfer time, can be substantially reduced according to German Published, Non-Prosecuted Application DE-OS 30 33 792, corresponding to U.S. Application Ser. No. 600,604, now U.S. Pat. No. 4,532,683, granted Aug. 6, 1985, when the stretched fabric web, drawn over the contact table to the cutting edge, is randomly pulled downward together with the contact table, so that all of the needles exit upward and thereby cut the needles free altogether at the fabric speed. A withdrawal of the needle is also no longer required, while the needles are automatically cut out from their respective fabric tube by the circular knife, because of the fabric web course, which is angular or bent downward from the working floor, respectively.

However, the corduroy cutting machine according to German Published, Non-Prosecuted Application DE-OS 30 33 792 and the method thereof for cutting the needles free before a seam, have proved that a certain danger exists for so-called fine cords, for which only very thin needles can be used because of the closeness of the side by side tubes. The danger is that of bending of the needle points and therefore of the destruction of the needles generally, when the rear table and the contact table are lowered and the needles do not have enough inherent stability to resist the tension of the inclined fabric web.

SUMMARY OF THE INVENTION

It is accordingly an object of the invention to provide a corduroy cutting machine and a method of operation thereof, which overcomes the hereinafore-mentioned disadvantages of the heretofore-known devices and methods of this general type, and to further develop the operation for cutting the needles free, which is known from German Published, Non-Prosecuted Application DE-OS 30 33 792, so that the machine and the process belonging to it can also find application in the cutting of fine cords, thereby making the machine universally usable.

With the foregoing and other objects in view there is provided, in accordance with the invention, a needle supporting table being movable in a region directly below any of the needle points still disposed in the working plane when the rear table is lowered.

In accordance with another feature of the invention, during normal operation, the needle supporting table is disposed below the working plane at a distance from the needle point and is movable in the given travel direction to the region below the needle points.

In accordance with a further feature of the invention, the contact table is lowered as the supporting table moves in the given travel direction.

Under the normal working plane of the corduroy cutting machine, a so-called needle supporting table is disposed according to the invention, which performs no function during normal cutting operation and also prevents disturbances. The supporting table can be connected with the rear table. Preferably, the supporting table is supported in such a way that it can be moved directly under the working plane in the fabric travelling direction, if required. However, in principle the needle supporting table can be replaced at any other given position of the machine below the working plane during normal cutting operation.

According to the invention, by lowering the rear table, the supporting table is moved parallel to the fabric web travelling direction, until the needle points are supported thereby.

The displacement of the supporting table under the needles and needle points, respectively, according to the invention, provides a previous lowering or swinging out of the way of the contact table, which otherwise is situated under the needles and their points. The securing of the machine against the need withdrawal downward (through the ground web or backing), which is provided by stopping the machine when the needles contact the contact table, is interrupted after lowering the contact table.

To prevent this problem the needle supporting table is in the form of a wedge having an edge facing the needle points and a flank beginning from the edge and sloping upward against the given travel direction.

In accordance with an added feature of the invention, the needle supporting table has a side facing upstream in the given travel direction, the side being angled downward corresponding to the lowering of the table for cutting the fabric web free.

In accordance with again another feature of the invention, the needle supporting table has an underside being substantially parallel to the normal working plane, and the needle supporting table, including the flank and side inclining and declining in the given travel direction and normal to the working plane, is small or thin enough to be insertible between the contact table when swung away and the fabric web beyond the region below the needle points.

Then, when a needle, which exists downward through the ground web, is met on the wedge flank, the needle is guided again upward through the wedge flank and at the top of the border or ledge it is forced outward from the fabric tube through the web on its upper side because of the bend in the fabric web.

In accordance with again a further feature of the invention, the needle supporting table is fixedly coupled the rear table. The lowering of the fabric web is started in practice through a combined, coupled movement of the needle supporting table and the rear cutting table, respectively. This means, that the downward movement of the rear cutting table is coupled with the forward movement of the supporting table in the area under the needles and needle points, respectively. Because of this forward movement of the supporting table, the contact table, which is swung out of the way from its normal position below the needles, should preferably only be lowered or swung out of the way far enough so that the supporting table with the wedge is inserted between the fabric web and the contact table.

In accordance with again an added mode of the invention, there is provided a method which includes initially moving the needle supporting table in the region below the needle points while lowering the fabric web from the working plane for cutting the needles free, and supporting the needles along with the needle points on the needle supporting table.

In accordance with again an additional mode of the invention, there is provided a method which includes supporting the needles and needle points on the needle supporting table by lowering the fabric web.

In accordance with yet another mode of the invention, there is provided a method which includes coordinating movements of the rear table, needle supporting table and contact table with each other by force.

DESCRIPTION OF THE PREFERRED EMBODIMENT

Figure 1:
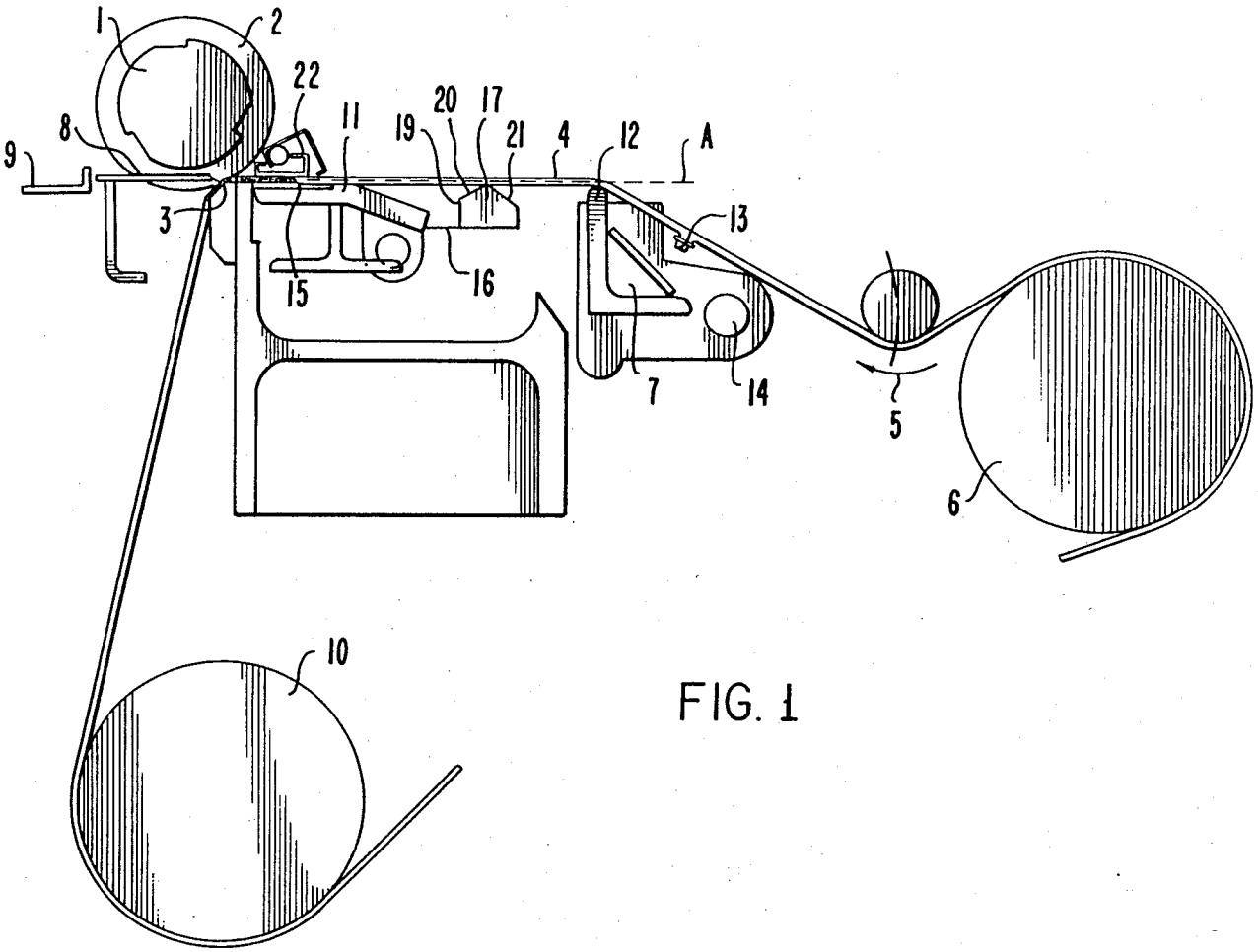
FIG. 1 is a partial cross-sectional view, normal to the axis of a knife shaft of a corduroy cutting machine with a fabric web being guided for a normal cutting operation.
Figure 2:
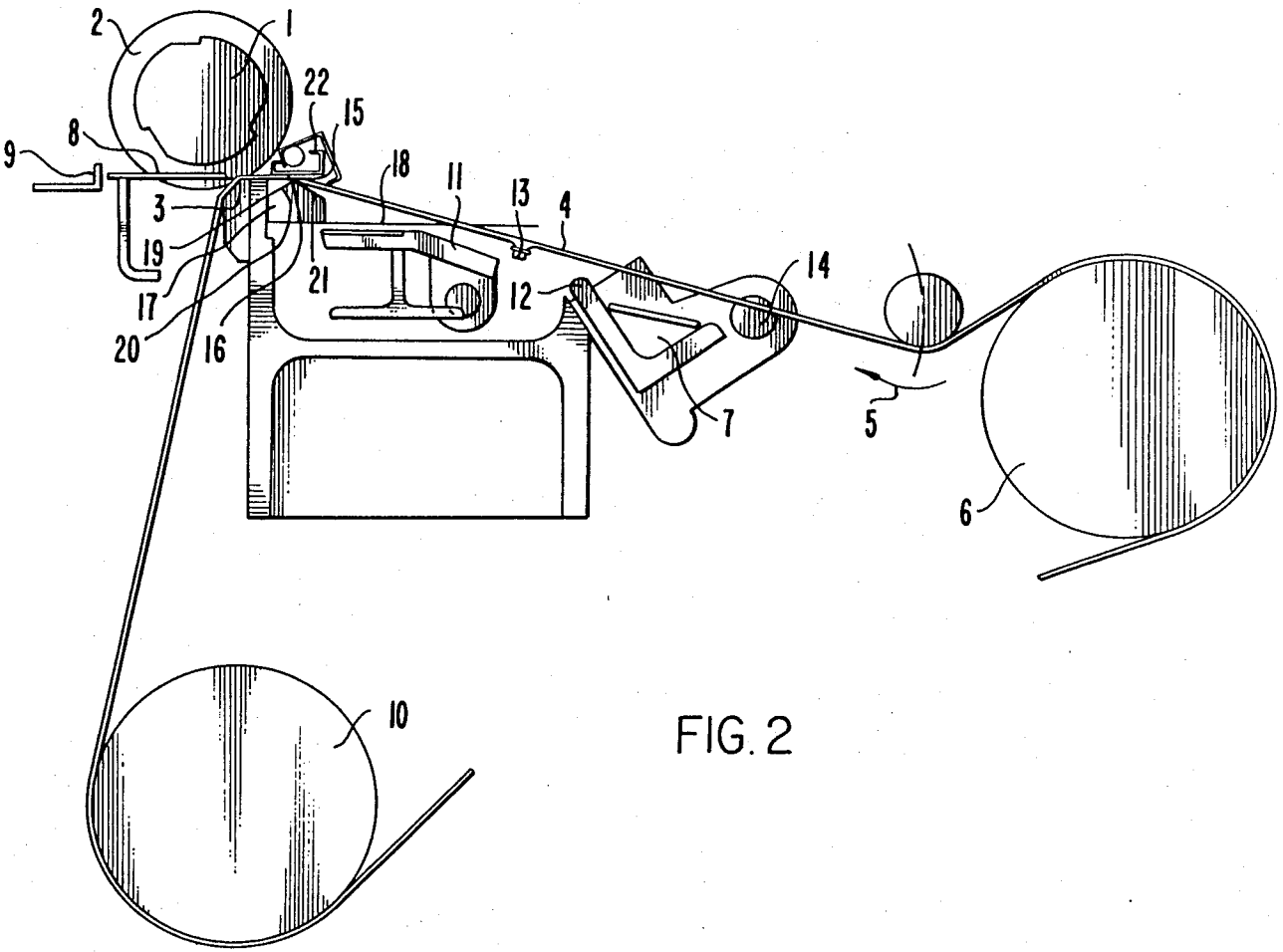
FIG. 2 is a similar cross-sectional view of the machine according to FIG. 1, with the fabric web lowered.

Referring now in detail to FIGS. 1 an 2 of the drawings as a whole, it is seen that the machine according to FIGS. 1 and 2 has a plurality of circular knives 2 adjacent to one another on a cutting knife shaft 1. The circular knives 2 are associated with the cutting edge 3. A fabric web 4 travels in the direction of an arrow 5, over a feed roller 6 and so-called rear table 7 onto the needles 8 disposed at cutting edge 3, so that a needle 8 is led into each of the weft tubes of the fabric web 4, which are to be cut open. The circular knife 2, associated with each respective needle, projects through a longitudinal slot formed in each needle so that the circular knife 2 projects up a given distance from the cutting edge 3, which is especially determined by the thickness of the ground web or backing of the fabric web 4. As a rule, the needles 81 are alternately pushed from behind by push rods or rams 9 so that they are respectively pressed forward in a jerky manner into the weft tube of the fabric web 4. The respective longitudinal tension or stretching in the warp direction of the fabric web, which is required for acceptable cutting, is secured by the feed roller 6 as well as by a take-up roller 10. For the registration of the needle withdrawal and for guiding the fabric web 4 in vicinity of the needles 8, the corduroy cutting machine has a so-called contact table 11. The use of this contact table 11 ensures that because of the needle withdrawal downward and by using different needle lengths, a safe braking of the machine on short notice is caused by a signal passed on from the contact table 11, so that during withdrawal, the respective needle 8 comes to a standstill just before running up onto the cutting edge 3. The term "withdrawal" in this context is understood to mean that the needles penetrate through or emerge from the base or substrate and the pile of the fabric web. Corduroy cutting machines are also provided with contact rails or the like above the fabric web 4 for the registration and signalization of the upward needle withdrawal. An upper contact table 22 serving as a contct rail is shown in FIGS. 1 to 4.

The rear table 7 with a given rear table edge 12, is at the same height as the cutting edge 3 in the so-called working plane A, during the normal operation of the machine according to FIG. 1. At the same time, the contact table 11 assigned to the needles 8 as a lower contact rail, is situated so close to the fabric web 4, that due to a needle withdrawal downward, all useable needle lengths will cause the machine to stop immediately.

Figure 4:
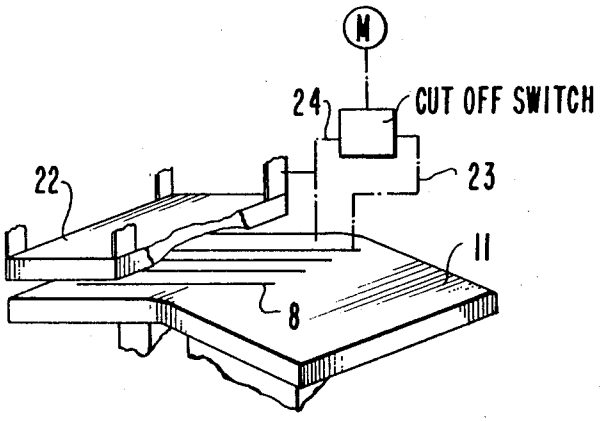
FIG. 4 is an enlarged, fragmentary, perspective view of the contact tables and the mechanism for stopping the machine.

As seen in the enlarged view of the contact table 11 and the upper contact table 22 in FIG. 4, a cut off switch is connected to the needles 8 by a line 23 and to the tables 11, 22 by a line 24. A motor M driving the machine is also connected to the switch. When the needles 8 touch the contact table 11 or the upper contact table 22, the switch stops the machine.

The machine is also provided with the table 7 for the purpose of cutting the needles 8 free from the fabric web 4. Preferably, the rear table 7 is disposed directly before a seam 13 for transferring the needles onto the next fabric web. The rear table 7 swings downward around its pivot axis 14 according to FIG. 2, so that the fabric web 4 is lowered from the working plane A, which extends through the needles 8, and the needles 8 or their respective points 15 all exit upward together from their weft tubes. The contact table 11 is especially formed according to German Published, Non-Prosecuted Application DE-OS 30 33 792 as a plate spring. It should be noted that the above-described contact between the needles and the contact table merely stops the machine from running. The movement of the tables only occurs when a seam is detected.

Because of the swinging of the rear table 7, and because of the corresponding bending of the fabric web occurring at the needle points 15, the contact table 11 is also gradually lowered downward in the same manner as the bending position 16 of the fabric web 4, and travels from the needle points 15 to the cutting edge 3. When the needles are thick enough, in other words when they have sufficient inherent stability, there are no difficulties in this respect and the withdrawal of the needles occurs in a jerky manner during the next push of the ram 9 for the respective needles. Then, as soon as the cut off position is moved forward to the cutting edge 3, the needles 8 lie above the fabric.

Through the use of this procedure, difficulties arise such as when cutting fine cord with many ribs that are close to each other side by side, and the needles are very thin and do not have sufficient inherent rigidity to resist the tension of the fabric web 4, which initially acts only on the needle points 15 by the lowering of the rear table 7. The danger then exists of a bending of the needle points, in which case the needles do not exit from the weft tubes and are useless.

According to the invention, this problem is prevented through the use of a needle supporting table 17, which moves by lowering the rear table 7 in the area directly under the needle points 15, that are still in the working plane A. During normal operation of the machine, this supporting table 17 should be disposed below the working plane A at a distance in front of the needle points 15. Furthermore, the supporting table 17 should be moved in a guideway 18 in the fabric travelling direction 5 in the region below the needle points 15, coupled with the lowering movement of the rear table 7, when a seam 13, which is gripped by a seam feeler 101, appears before the cutting area.

Figure 3:
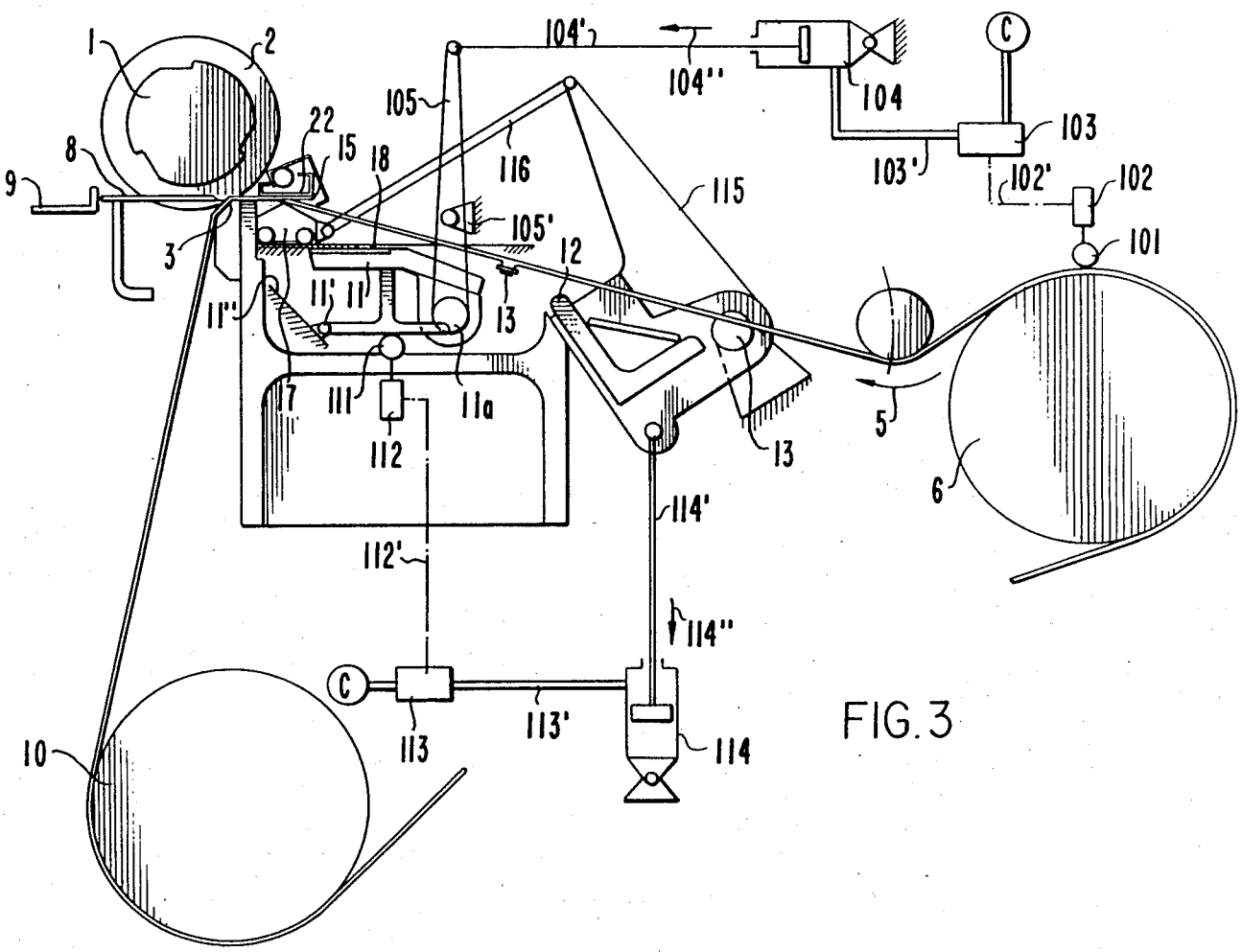
FIG. 3 is a view similar to FIG. 2 including details of the mechanisms for operating the tables of the invention.

According to FIG. 3, when a seam 13 passes a seam feeler or electric eye 101, it trips a switch 102 which opens a pneumatic value 103. The valve 103 allows the passage of compressed air from a compressed air source C into a tube 103' leading to a pneumatic cylinder 104. The air supply moves a piston to the left in FIG. 3 which moves a piston rod 104' in the direction of the arrow 104''. The piston rod moves a lever 105 through a pivot joint. The lever is pivoted at a bracket 105' and is connected to the contact table 11 at a pivot point 11*a*. The lever 105 therefore moves the contact table 11 from the position shown in FIG. 1 to the lowered position shown in FIGS. 2 and 3. The table 11 has a roller 11' which moves along an inclined surface 11''.

When the contact table 11 is lowered, it contacts a feeler 111 which trips a switch 112. The switch 112 signals a pneumatic valve 113 over a line 112' so that compressed air from a compressed air source C enters a tube 113'. The tube is connected to a pneumatic cylinder 114 having a piston and a piston rod 114'. The compressed air moves the rod 114' in the direction of the arrow 114'' in order to pivot the rear table about the pivot axis 14.

A lever 115 is attached to the rear table 7 and is articulatingly connected through a rod 116 to the supporting table 17. When the rear table 7 is lowered into the position shown in FIGS. 2 and 3, the supporting table 17 is therefore slid to the left along the guideway 18.

Naturally, many different mechanisms can be used for coordinating movement of the three tables and FIG. 3 illustrates but one. Furthermore, the device can be operated manually. When an operator sees a seam 13 approaching, he merely lowers the rear table 7 about the pivot axis 14 and pushes the supporting table 17 to the left. The contact table 11 can be constructed as a springy resilient table, as mentioned above, so that the weight of and tension on the web 4, lowers the table 11. Otherwise, the table 11 can also be lowered manually.

Obviously, the operating area of the supporting table 17 below the respective needles of points 15 is occupied in a normal way by the contact table 11. Preferably, the movement of the supporting table 17 in the web travel direction 5 with approach of the seam 13, is connected with the downward or swinging movement of the contact table 11. However, after the operation of the corresponding mechanical parts, the heretofore existing protection of the machine against downward needle withdrawals (through the ground web or backing) is omitted. To prevent this problem, which results from the contact table 11 swinging out of the way, the supporting table 17 is in the form of a wedge having a flank 20 further according to the invention, beginning at the edge 19 facing the needle point 15, and sloping upwards against the fabric travelling direction 5. Therefore, the supporting table can preferably be in the form of a border or ledge of a wedge with an underside extending parallel to the normal working plane A and a backwardly projecting flank 20 of a wedge sloping against the fabric transport direction. A supporting table 11, which is in the form of a thin border or ledge of a wedge in the direction normal to the working plane A, permits insertion into the gap between the fabric web and the lowered contact table 11.

The supporting table 17 should be angular at least on its rear side facing the fabric travel direction, similar to the downward movement, provided when the fabric web 4 is cut free. Practically speaking, the rear side of the needle support table 17 is in the form of a flank 21 of a wedge, with a slope corresponding to the lowering of the fabric web 4 as compared to the normal working plane A. In practice, the lowering of the fabric web 4 is started through a combined or coupled movement of the supporting table 17 and the rear cutting table 7, respectively; this means that the downward movement of the rear cutting table 7 is coupled with the forward movement of the supporting table 17 to the needle points, an dthe swinging of the contact table 11 occurs timely.

I claim:

1. Corduroy cutting machine, comprising a shaft, a plurality of circular knives disposed adjacent each other on said shaft for cutting open floating wefts of a corduroy fabric web being moved along a given travel direction, a plurality of needles having points and having longitudinal slots formed therein for receiving portions of said knives defining a cutting edge opposite said knives, means for inserting said needles into the floating wefts to be cut open in the direction opposite said given travel direction, a contact table disposed below said needle points, means for stopping the cutting machine upon contact between the contact table and one of said needles, said needles and said contact table defining a working plane for a cutting operation into which the fabric web is guided from below over said contact table to said cutting edge, a rear table disposed at a distance from said contact table upstream of said needle points in said given travel direction, means for holding said rear table in the working plane during the cutting operation, means for lowering said rear table, and said contact table from said working plane, a needle supporting table, and means for moving said needle supporting table into a region directly below any of said needle points still disposed in said working plane when said rear table is lowered.

2. Corduroy cutting machine according to claim 1, wherein said means for moving said needle supporting table include means for placing said needle supporting table below said working plane at a distance from said needle points during normal operation and for moving said needle supporting table in said given travel direction to said region below said needle points.

3. Corduroy cutting machine according to claim 2, wherein means for lowering said rear table and said contact table, lowers said contact table as said supporting table moves in said given travel direction.

4. Corduroy cutting machine according to claim 1, wherein said needle supporting table is in the form of a wedge having an edge facing said needle points and a flank beginning from said edge and sloping upward against said given travel direction.

5. Corduroy cutting machine according to claim 4, wherein said needle supporting table has a side facing upstream in said given travel direction, said side being angled downward corresponding to said lowering of said rear table for cutting the fabric web free.

6. Corduroy cutting machine according to claim 5, wherein said needle supporting table has an underside being substantially parallel to said working plane, and said needle supporting table, including said flank and side, is small enough to be inserted between said contact table when lowered and the fabric web at said region below said needle points.

7. Corduroy cutting machine according to claim 1, wherein said needle supporting table has a side facing upstream in said given travel direction, said side being angled downward corresponding to said lowering of said rear table for cutting the fabric web free.

8. Corduroy cutting machine according to claim 1, wherein said needle supporting table is fixedly coupled to said rear table.

9. Method of operating a corduroy cutting machine, including a shaft, a plurality of circular knives disposed adjacent each other on said shaft for cutting open floating wefts of a corduroy fabric web being moved along a given travel direction, a plurality of needles having points and having longitudinal slots formed therein for receiving portions of the knives defining a cutting edge opposite the knives, the needles being inserted into the floating wefts to be cut open in the direction opposite the given travel direction, a contact table disposed below the needle points for stopping the cutting machine upon contact by one of the needles, the needles and the contact table defining a working plane for a cutting operation into which the fabric web is guided from below over the contact table to the cutting edge, a rear table disposed at a distance from the contact table upstream of the needle points in the given travel direction, means for holding said rear table in the working plane during the cutting operation, means for lowering said rear table and said contact table from the working plane, the rear table being held in the working plane during the cutting operation and the rear table and the contact table being lowerable at random from the working plane, and a needle supporting table being movable in a region directly below any of the needle points still disposed in the working plane when the rear table is lowered, which comprises initially moving the needle supporting table in the region below the needle points while lowering the fabric web from the working plane for cutting the needles free, and supporting the needles along with the needle points on the needle supporting table.

10. Method according to claim 9, which comprises automatically moving the rear table and the needle supporting table through movements of the contact table.

* * * * *